US011052550B2

(12) United States Patent
Alexander

(10) Patent No.: US 11,052,550 B2
(45) Date of Patent: Jul. 6, 2021

(54) FOLDING TOOL WITH A TRACTION SURFACE OPENING MECHANISM

(71) Applicant: Spyderco, Inc., Golden, CO (US)

(72) Inventor: Paul Alexander, Ypsilanti, MI (US)

(73) Assignee: Spyderco, Inc., Golden, CO (US)

( * ) Notice: Subject to any disclaimer, the term of this patent is extended or adjusted under 35 U.S.C. 154(b) by 0 days.

(21) Appl. No.: 16/255,756

(22) Filed: Jan. 23, 2019

(65) Prior Publication Data

US 2019/0224860 A1 Jul. 25, 2019

Related U.S. Application Data

(60) Provisional application No. 62/620,863, filed on Jan. 23, 2018.

(51) Int. Cl.
*B26B 1/04* (2006.01)
*B26B 1/02* (2006.01)

(52) U.S. Cl.
CPC ..... *B26B 1/044* (2013.01); *B26B 1/02* (2013.01); *B26B 1/04* (2013.01)

(58) Field of Classification Search
CPC ..... B26B 1/02; B26B 1/04; B26B 1/044
See application file for complete search history.

(56) References Cited

U.S. PATENT DOCUMENTS 4,985,998 A 1/1991 Howard
5,596,808 A 1/1997 Lake et al.
5,615,484 A 4/1997 Pittman
5,815,927 A * 10/1998 Collins ..... B26B 1/046 30/161
6,553,672 B2 4/2003 Glesser et al.
6,751,868 B2 6/2004 Glesser
6,810,588 B1 * 11/2004 Cheng ..... B26B 1/046 30/153
6,918,184 B2 7/2005 Glesser
7,107,686 B2 * 9/2006 Linn ..... B26B 1/02 30/159
8,307,555 B2 * 11/2012 Onion ..... B26B 1/02 30/155
9,327,413 B2 5/2016 Sakai
2009/0056146 A1 * 3/2009 Duey ..... B26B 1/048 30/159
2010/0242288 A1 * 9/2010 Onion ..... B26B 1/02 30/160
2012/0144677 A1 * 6/2012 Chang ..... B26B 1/04 30/161

(Continued)

OTHER PUBLICATIONS

"Andre de Villiers Classic Butcher Flipper Knife Knurled/Gold HW (4" Satin) AdV," Blade HQ, 2018, 3 pages [retrieved online from: www.bladehq.com/item--Andre-de-Villiers-Classic-Butcher--51189].

(Continued)

*Primary Examiner* — Stephen Choi
(74) *Attorney, Agent, or Firm* — Sheridan Ross P.C.

(57) ABSTRACT

A folding knife is provided with an opening mechanism having a traction surface to aid users in rotating the blade from the closed position to the open position and to assist with opening the folding knife. More specifically, the traction surface is located on an outer surface of the tang of the blade and extends outwardly from the handle when the blade is in the closed position.

21 Claims, 6 Drawing Sheets

(56) References Cited

U.S. PATENT DOCUMENTS

| | | | | |
|---|---|---|---|---|
| 2016/0075037 | A1* | 3/2016 | Ikoma | B26B 1/042 30/161 |
| 2016/0121493 | A1 | 5/2016 | Ikoma | |
| 2016/0136824 | A1 | 5/2016 | Glesser | |
| 2017/0232621 | A1* | 8/2017 | Sung | B26B 1/02 30/158 |
| 2018/0200897 | A1* | 7/2018 | Alexander | B26B 1/04 |

OTHER PUBLICATIONS

"Kizer Vanguard Cucchiara Bad Dog Flipper Knife Black G-10 (3" Stonewash) V3463A1," Blade HQ, 2017, 3 pages [retrieved online from: https://www.bladehq.com/item--Kizer-Vanguard-Cucchiara-Bad-Dog--50468].

"Knurling," Wikipedia, last edited Dec. 2, 2016, 3 pages [retrieved online from: web.archive.org/web/20161220191036/https://en.wikipedia.org/wiki/Knurling].

Andersen "Review: CRKT Homefront by Ken Onion," The Truth About Knives, Jan. 2017, 13 pages [retrieved online from: www.thetruthaboutknives.com/2017/01/review-crkt-homefront-by-ken-onion/].

* cited by examiner

FOLDING TOOL WITH A TRACTION SURFACE OPENING MECHANISM

CROSS REFERENCE TO RELATED APPLICATIONS

This application claims priority from U.S. Provisional Patent Application Ser. No. 62/620,863, filed Jan. 23, 2018, entitled "Folding Knife with a Traction Surface Opening Mechanism"; the entire disclosure of which is hereby expressly incorporated by reference in its entirety.

FIELD OF THE INVENTION

The present invention relates to tools and cutting instruments and more specifically to folding tools with opening mechanisms having a traction surface to aid users in rotating the blade from the closed position to the open position and to assist with opening the folding knives.

BACKGROUND OF THE INVENTION

Cutting instruments have been used for centuries by craftsmen, hunters, and others requiring a sharp cutting instrument. Pocket knives are commonly carried by sportsmen, craftsmen and other users who desire a compact, portable blade which can be safely folded and transported in a pocket or attached to a belt. More recently, fixed length knives have been replaced with popular folding knives, which generally have two positions. In an open or extended position of use, the knife cutting blade is extended to expose the blade cutting edge and permit cutting therein. In a closed position, the cutting edge of the blade is stored within a cavity or recess in the handle portion of the knife, thus preventing the blade from being exposed. While folding knives are compact and portable in a closed position, a folding knife that is difficult to open presents a host of problems. Although folding knives are extremely convenient, they can potentially become dangerous if the cutting blade does not have a locking mechanism to securely keep the knife blade in the first extended position of use.

Users carry folding knives due to their compact and portable profile, but the intended use of folding knives includes emergency situations. Sportsman, craftsman, and other users are often engaged in activities that are inherently dangerous or take the user to a location that is remote from emergency services. In these situations, an emergency can arise where the user may need to immediately use his or her folding knife and time is of the essence. In an emergency, a user needs a folding knife that is quickly and easily opened from a closed position to an open position, and preferably with one hand.

Beyond emergencies, a user needs a folding knife that is quickly and easily opened from a closed position to an open position to improve the effectiveness of the folding knife and avoid injury to himself or herself. The design of a folding knife and the configuration of its components can impede the effectiveness of the folding knife.

Folding knives typically have a first scale and a second scale that form the handle portion of a folding knife. When the folding knife is in a closed position, the blade is stored within a cavity or recess created in part by the opposing scales. If the scales are larger in height relative to the height of the blade, then a greater portion of the blade is stored in the cavity or recess and a lesser portion of the blade is exposed for a user to grip. A user has greater difficulty gripping a smaller area of the blade, and this creates difficulty when opening the blade. Additionally, some blades are smaller than the scales such that little to no part of the blade is exposed when the knife is in the closed position.

One aspect of a folding knife that creates an increased risk of injury is resistance to opening. Often, folding knives have designs or configurations that create resistance to the motion of the blade to reduce the possibility that a folding knife will be unintentionally or accidentally opened. However, when a user attempts to open a folding knife with his or her fingernails, the resistance to opening can break, bend, or chip the user's fingernails or cause damage to the user's soft tissue.

Likewise, scales may interfere with the blade and create resistance. The blade pivots about a pin which also secures a first scale and a second scale to the folding knife. If the pin is short in length, the first scale and second scale may interfere with the heel end of the blade. The interference causes friction as the user opens the blade from a closed position, and thus the user must exert additional effort to open the blade.

Some existing folding knives have features that aid in opening a folding knife from a closed position. For example, some folding knives have a recess located on one side of the blade. The recess allows a user to insert his or her fingernail into the recess and pivot the blade from the closed position. However, the recess has several shortcomings. Only a fingernail may access the recess which places the fingernails under strain. Also, the recess typically exists only on one side of the blade. Applying force to only one side of the blade places the blade in torsion. The torsion creates a non-uniform force profile on the pin which results in increased resistance to opening. Some folding knives have one or two thumb studs on one or both sides of the blade. Thumb studs have their short comings. For example, they extend out from the blade and can catch on material or items. Further, if the blade only has one thumb stud on one side of the blade, then, like the recess, the user applies a force to only one side of the blade, which places the blade in torsion. Other folding knives have a flipper tab with or without knurling, which assists the user in opening the folding knife. However, the flipper tab has shortcomings, including that it sticks out when the blade is in the closed position and, therefore, the flipper tab can catch on the user's pocket or other material.

U.S. Pat. No. 6,553,672 to Glesser et al. discloses a folding knife with a compression locking mechanism, and is incorporated by reference herein in its entirety. U.S. Pat. No. 6,918,184 to Glesser discloses a folding knife lock integral stop pin, and is incorporated by reference herein in its entirety. U.S. Pat. No. 6,751,868 to Glesser discloses a folding knife with a substantially spherical locking mechanism, and is incorporated by reference herein in its entirety. U.S. Pat. No. 9,327,413 to Sakai discloses a folding knife with a two-piece backlock, and is incorporated by reference herein in its entirety. U.S. Patent Publication No. 2016/0136824 to Glesser discloses a folding knife with a rotational wedge locking mechanism, and is incorporated by reference herein in its entirety. U.S. Pat. No. 5,615,484 to Pittman discloses a cam lock for a folding knife blade, and is incorporated by reference herein in its entirety. U.S. Pat. No. 4,985,998 to Howard discloses a folding knife with a blade lock, and is incorporated by reference herein in its entirety. U.S. Pat. No. 5,596,808 to Lake et al. discloses a folding knife with a liner lock, and is incorporated by reference herein in its entirety.

Thus, there is a strong need in the cutlery industry for a folding knife with an improved opening mechanism, and preferably one that allows for one-handed opening of a knife blade with a user's thumb or index finger.

SUMMARY OF THE INVENTION

One aspect of embodiments of the present invention is to provide a folding knife with an opening mechanism that assists in safely opening the blade to an extended position and provides traction for the user when opening the blade. Note that "open" may be used herein interchangeably with "extended." Some embodiments of the present invention provide opening features (also called "opening mechanisms" herein) on the blade of the folding knife to increase the traction and/or surface area between the user and the blade.

It is thus an aspect of embodiments of the present invention to provide a folding knife that is quickly and easily openable from a closed position to an open position, and preferably with a user's thumb or index finger. It is a further aspect of embodiments of the present invention to improve the effectiveness of the folding knife, to reduce the likelihood of injury when a user rotates a folding knife blade, and to more easily overcome the resistance required to open the folding knife blade.

One aspect of embodiments of the present invention is to provide an increase in traction on the contact area for a user's thumb or fingers when opening the knife. This leads to an improved effectiveness of the folding knife and a reduced risk of injury because increased traction provides greater control for a user and, thus, less likelihood of accidentally injuring himself.

It is another aspect of embodiments of the present invention to provide a folding knife with a component that increases the traction with a user's finger when using the knife in an open position. The increased traction provides the user with greater control of the knife while using the knife with the blade in an extended position.

Another aspect of embodiments of the present invention is to increase the moment force about the pivot pin to help the user overcome resistance to opening the folding knife blade. When the user moves the blade of the folding knife from a closed position to an open position, the user experiences a resistance to opening the folding knife blade. Opening features that are advantageously located on the folding knife blade help the user gain more leverage about the pivot pin to help the user overcome resistance to opening the folding knife blade.

In some embodiments of the present invention, the folding knife blade includes a traction surface on the tang or rear surface of the blade. The traction surface extends upwardly from the handle when the blade is in the closed position. In some embodiments, the traction surface is knurled, which can be the traditional crisscross pattern, a series of straight ridges, or a helix of straight ridges. In other embodiments, the traction surface includes a plurality of parallel grooves and ridges. In further embodiments, a portion of the traction surface is parallel with the lower surface of the handle when the knife is in the open position such that the traction surface provides additional traction for the user when using the knife. Thus, the traction surface assists the user in opening the folding knife blade and gives the user additional control when using the folding knife.

Knurling is a manufacturing process typically conducted on a lathe, whereby a pattern of straight, angled, or crossed lines is cut or rolled into the material. The operation is performed for producing indentations on a part of a workpiece. Knurling allows hands or fingers to get a better grip on the knurled object than would be provided by the originally smooth metal surface. The pattern can be a series of straight ridges or a helix of straight ridges rather than the more-usual crisscross pattern. Knurling may also be used as a method of texturing a surface, because a rolled-in knurled surface has raised-up areas surrounding the depressed areas. Tool handles, mechanical pencils, barbell bars, and the knobs on electronic equipment are frequently knurled. Knurling is also used on the grips of darts and the foot pegs of BMX bicycles. Aside from adding functionality to an object, knurling also adds a decorative pattern to the material. The knurled nut is one application, which uses a knurled finish instead of hexagonal or square edges which helps in tightening or loosening the nut without the use of a tool. The knurled surfaces provide enough grip to hold the nut between the thumb and forefinger, hence it is also called a thumb nut. More common than knurl cutting, knurl rolling is usually accomplished using one or more very hard rollers that contain the reverse of the pattern to be imposed. It is possible for a straight knurl to be pressed with a roller, however the material needs to be supported adequately to avoid deformation.

In some embodiments, a folding knife is provided comprising: a handle with two sides, a forward end, and a rear end opposite the forward end, wherein at least one side has a cutout proximate the forward end; a blade movable from a first extended position to a second closed position and having a forward end, a tang on a rear end, a spine, a cutting edge opposite the spine, and a longitudinal axis substantially parallel to the spine, wherein the blade is pivotally interconnected to the forward end of the handle; a traction surface located on an outer surface of the tang, wherein at least a portion of the traction surface extends upwardly above the cutout in the handle to facilitate engagement when the blade is in the second closed position, and wherein when a force is applied to the traction surface when the blade is in the second closed position, the blade rotates to the first extended position; and a locking mechanism movable from a first locked position to a second released position, wherein the locking mechanism is in the first locked position when the blade is in the first extended position.

In some embodiments, a folding tool is provided comprising: a handle with two sides, a forward end, and a rear end opposite the forward end, wherein at least one side has a cutout proximate the forward end; a tool movable from a first extended position to a second closed position and having a forward end, a tang on a rear end, and a longitudinal axis, wherein the tool is pivotally interconnected to the forward end of the handle; a traction surface located on an outer surface of the tang, wherein at least a portion of the traction surface extends upwardly above the cutout in the handle to facilitate engagement when the tool is in the second closed position, and wherein when a force is applied to the traction surface when the tool is in the second closed position, the tool rotates to the first extended position; and a locking mechanism movable from a first locked position to a second released position, wherein the locking mechanism is in the first locked position when the tool is in the first extended position.

In additional or alternative embodiments, the tool is a blade having a spine and a cutting edge opposite the spine and the longitudinal axis is substantially parallel to the spine. In additional or alternative embodiments, the locking mechanism comprises at least one of a liner lock, a frame lock, a compression lock, a side-entry lock, a side detent, a detent lock, or any combinations thereof. In additional or alternative embodiments, the traction surface is knurled.

In additional or alternative embodiments, the traction surface comprises a crisscross knurled pattern, a knurled pattern of straight ridges, or a helix of straight ridges. In additional or alternative embodiments, the traction surface extends around the tang at least about 90 degrees.

In additional or alternative embodiments, a second portion of the outer surface of the tang comprises a substantially flat surface that is substantially smooth. In additional or alternative embodiments, a portion of the tang comprising the traction surface and the substantially flat surface extends outwardly beyond the forward end of the handle when the tool is in the second closed position. In additional or alternative embodiments, the substantially flat surface engages a portion of the locking mechanism when the tool is in the first extended position.

In additional or alternative embodiments, the folding tool further comprises a first liner, a second liner, a first scale, and a second scale that are substantially parallel to one another, wherein there is a space between the first and second liners that forms a channel for receiving the tool when the tool is in the second closed position, and wherein a portion of the first liner proximate the forward end of the handle and a portion of the second liner proximate the forward end of the handle comprise a traction portion with alternating raised ridges and recessed portions.

In additional or alternative embodiments, at least a portion of the traction surface extends outwardly from the forward end of the handle when the tool is in the second closed position. In additional or alternative embodiments, a portion of the traction surface is substantially parallel with a bottom surface of the handle when the tool is in the first extended position. In additional or alternative embodiments, the outer surface of the tang is oriented substantially perpendicular to the longitudinal axis of the tool.

In some embodiments, a folding knife is provided comprising: a handle having a first side with a first liner, a first scale, and a first cutout in a forward end of the handle, wherein the first cutout forms an angle greater than about 90 degrees; a second side with a second liner, a second scale, and a second cutout in the forward end of the handle, wherein the second cutout forms an angle greater than about 90 degrees, and wherein there is a space between the first and second liners that forms a channel; a blade movable from a first extended position to a second closed position and having a forward end, a tang on a rear end, a spine, a cutting edge opposite the spine, and a longitudinal axis extending from the forward end to the rear end, wherein the blade is pivotally interconnected to the forward end of the handle via a pin, and wherein the channel receives the cutting edge of the blade when the blade is in the second closed position; a traction surface extending along at least about 60 degrees of an exposed outer surface of the tang when the blade is in the second closed position, wherein the traction surface extends outwardly from the first and second cutouts in the handle when the blade is in the second closed position, wherein a second portion of the tang comprises a substantially flat surface that is substantially smooth, and upon applying a reward-oriented force to the traction surface the blade rotates around the pin to the first extended position; and a liner lock cut into the first liner, wherein the liner lock is movable from a first locked position to a second released position, wherein the liner lock is in the first locked position when the blade is in the first extended position, and wherein the substantially flat surface of the tang engages a portion of the liner lock when the blade is in the first extended position.

In additional or alternative embodiments, the traction surface is knurled. In additional or alternative embodiments, the traction surface comprises a crisscross knurled pattern, a knurled pattern of straight ridges, or a helix of straight ridges. In additional or alternative embodiments, the traction surface is recessed within the channel when the blade is in the first extended position. In additional or alternative embodiments, the exposed outer surface is substantially perpendicular to the longitudinal axis of the blade.

In some embodiments, a method of opening a folding knife with one hand is provided, comprising: providing the folding knife comprising: a handle; a blade movable from a first extended position to a second closed position and having a forward end, a tang on a rear end, a spine, a cutting edge opposite the spine, and a longitudinal axis, wherein the blade is pivotally interconnected to a forward end of the handle; a traction surface located on an outer surface of the tang, wherein the outer surface is positioned substantially perpendicular to the longitudinal axis of the blade and extends upwardly above a portion of the handle when the blade is in the second closed position to facilitate engagement; and a locking mechanism movable from a first locked position to a second released position, wherein the locking mechanism is in the first locked position when the blade is in the first extended position; applying a force in a rearward-oriented direction to the traction surface to facilitate rotation of the blade from the second closed position to the first extended position; and locking the blade in the first extended position with the locking mechanism.

In additional or alternative embodiments, the locking mechanism includes a portion of a liner in the handle that engages a portion of the tang when the blade is in the first extended position. In additional or alternative embodiments, the traction surface is knurled. In additional or alternative embodiments, the traction surface comprises a crisscross knurled pattern, a knurled pattern of straight ridges, or a helix of straight ridges.

In additional or alternative embodiments, the method of opening a folding knife further comprises using an index finger or thumb to apply the force to the traction surface to open the folding knife.

In some embodiments, a folding knife is provided comprising: a handle; a blade movable from a first extended position to a second closed position and having a forward end, a tang on a rear end, a spine, a cutting edge opposite the spine, and a first side substantially parallel to a second side, wherein the blade is pivotally interconnected to a forward end of the handle; a traction surface located on an upper portion of an outer surface of the tang, wherein the outer surface is substantially perpendicular to the first and second sides of the blade and extends upwardly above a portion of the handle to facilitate engagement; and a locking mechanism movable from a first locked position to a second released position, and wherein the locking mechanism is in the first locked position when the blade is in the first extended position and is extending from the forward end of the handle.

In further embodiments, the locking mechanism comprises at least one of a liner lock, a frame lock, a compression lock, a side-entry lock, and a side detent. In some embodiments, the traction surface is knurled or comprises a crisscross knurled pattern, a knurled pattern of straight ridges, or a helix of straight ridges. In some embodiments, a second portion of the outer surface of the tang comprises a substantially flat surface that is substantially smooth. Further, the substantially flat surface engages a portion of the locking mechanism when the blade is in the first extended position. In various embodiments, the folding knife further comprises a first liner, a second liner, a first scale, and a second scale that are substantially parallel to one another, and wherein there is a space between the first and second liners that forms a channel for receiving the cutting edge of the blade when the blade is in the second closed position. In some embodiments, the traction surface extends outwardly from the handle when the blade is in the closed position and/or a portion of the traction surface is substantially parallel with a lower surface of the handle when the blade is in the first extended position.

In some embodiments, a folding knife is provided comprising: a handle comprising a first liner, a second liner, a first scale, and a second scale that are substantially parallel to one another; a blade movable from a first extended position to a second closed position and having a forward end, a tang on a rear end, a spine, a cutting edge opposite the spine, and a first side substantially parallel to a second side, wherein the blade is pivotally interconnected to a forward end of the handle, and wherein there is a space between the first and second liners that forms a channel for receiving the cutting edge of the blade when the blade is in the second closed position; a traction surface located on an upper portion of an outer surface of the tang, wherein the outer surface is substantially perpendicular to the first and second sides of the blade and extends upwardly above a portion of the handle to facilitate engagement; and a liner lock cut into the first liner, wherein the liner lock is movable from a first locked position to a second released position, and wherein the liner lock is in the first locked position when the blade is in the first extended position. In further embodiments, the traction surface is knurled, or the traction surface comprises a crisscross knurled pattern or a knurled pattern of straight ridges.

In some embodiments, a method of opening a folding knife with one hand is provided comprising: providing the folding knife comprising: a handle; a blade movable from a first extended position to a second closed position and having a forward end, a tang on a rear end, a spine, a cutting edge opposite the spine, and a first side substantially parallel to a second side; wherein the blade is pivotally interconnected to a forward end of the handle; a traction surface located on an upper portion of an outer surface of the tang, wherein the outer surface is substantially perpendicular to the first and second sides of the blade and extends upwardly above a portion of the handle to facilitate engagement; and a locking mechanism movable from a first locked position to a second released position, and wherein the locking mechanism is in the first locked position when the blade is in the first extended position; applying a force in a rearward-oriented direction to the traction surface to facilitate rotation of the blade from the second closed position to the first extended position; and locking the blade in the first extended position with the locking mechanism.

In further embodiments, the locking mechanism includes a portion of a liner that engages a portion of the tang when the blade is in the first extended position. In some embodiments, the traction surface is knurled, or the traction surface comprises a crisscross knurled pattern. In some embodiments, the method further comprises using a thumb or index finger to apply the force to the traction surface.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about." Furthermore, ranges have been discussed and used within the description. One skilled in the art would understand that any sub-range within the stated range would be suitable, as would any number within the broad range, without deviating from the invention.

The term "a" or "an" entity, as used herein, refers to one or more of that entity. As such, the terms "a" (or "an"), "one or more," and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. Section 112(f). Accordingly, a claim incorporating the term "means" shall cover all structures, materials, or acts set forth herein, and all equivalents thereof. Further, the structures, materials, or acts, and the equivalents thereof, shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

To provide further clarity to the detailed description provided herein in the associated drawings, the following list of components and associated numbering are provided as follows:

| Component No. | Component |
|---|---|
| 2 | Folding Knife |
| 6 | Blade |
| 8 | First Side of the Blade |
| 10 | Cutting Edge (of Blade) |
| 12 | Second Side of the Blade |
| 14 | Spine (of Blade) |
| 18 | Tip (of Blade) |
| 22 | Blade Pivot Point |
| 26 | Tang |
| 30 | Traction Surface (on Tang) |
| 32 | Flat Surface of Tang |
| 34 | Aperture |
| 38 | Rear End of Blade |
| 42 | Forward End of Knife |
| 46 | Rear End of Knife |
| 50 | Handle |
| 54 | Scales |
| 58 | Liners |
| 60 | Spacers |
| 62 | Forward End of Handle |
| 64 | Rear End of Handle |
| 66 | Bottom Surface of Handle |
| 68 | Top Surface of Handle |
| 70 | Clip |
| 74 | Channel (in Handle) |
| 78 | Liner Lock |
| 82 | Cutout in Handle (for Liner Lock) |
| 86 | Cutout in Forward End of Handle (for Traction Wheel) |
| 90 | Fastener |
| 94 | Fastener |
| 98 | Traction Portion |
| 98A | Raised Ridges of Traction Portion |
| 98B | Recessed Portions of Traction Portion |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

As described in detail below, various embodiments of the present invention include novel folding knife designs and configurations, comprising a textured opening mechanism and/or other features. The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed.

Although the following description and attached drawings show the folding tool as a folding knife, the invention can work on any folding tool that rotates from a closed position to an open position. For example, the invention can function on a scraper, nail file, scissors, screw driver, can opener, saw, etc., or any other folding tool.

Figure 1:
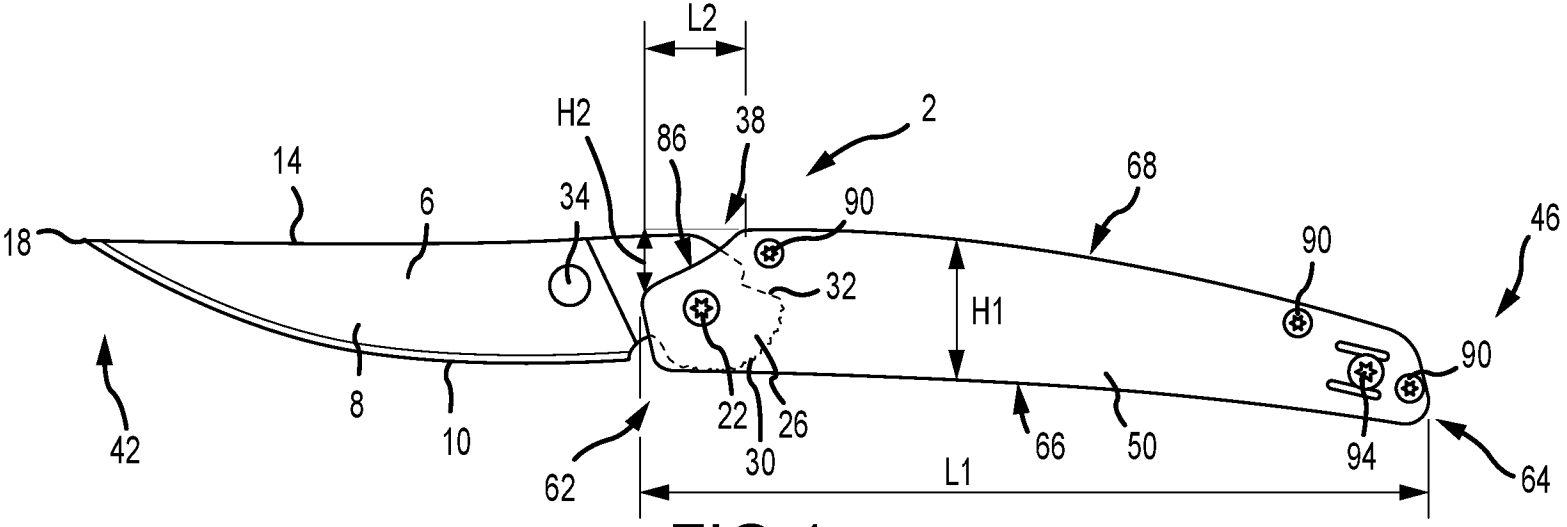
FIG. 1 is a front elevation view of a folding knife in an open and extended position.
Figure 2:
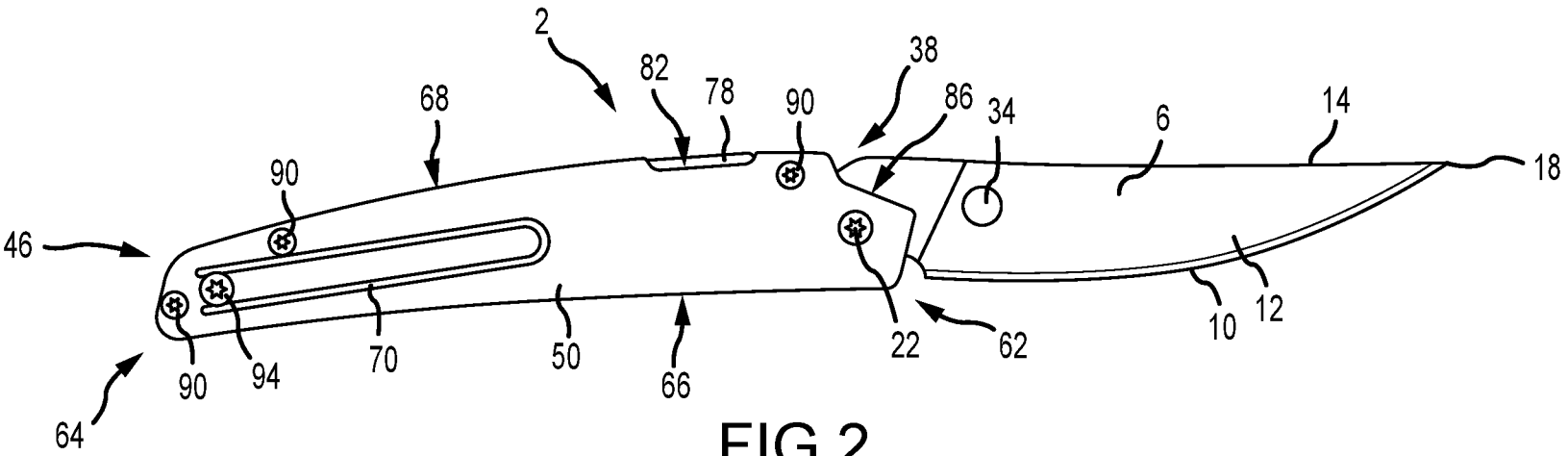
FIG. 2 is a rear elevation view of the folding knife, shown in an open position.

Referring now to FIGS. 1-2, the folding knife 2 is shown in the open and extended position. The folding knife 2 comprises a blade 6 with a cutting edge 10, a spine 14 positioned opposite the cutting edge 10, a first side 8 extending from the spine 14 to the cutting edge 10, a second side 12 extending from the spine 14 to the cutting edge 10, a tip 18 on one end (forward end 42 of the knife and blade), and a tang 26 (shown in phantom lines in FIG. 1) on the opposite end proximate the rear portion/end 38 of the blade 6. The tang 26 of the blade 6 is the portion that rotates around the pivot pin 22. Thus, the tang 26 is the portion of the blade 6 on the opposite side of the pivot pin 22 as the tip 18 of the blade 6. The tang 26 comprises a flat surface 32 that transitions into a traction surface 30. The spine 14 is positioned between the first side 8 and the second side 12 of the blade 6. The blade 6 is rotatable around a blade pivot point 22 (also called the blade rotation point, pivot pin, or pivot screw). The pivot point 22 is in the forward end 62 of the handle 50 and the rear end 38 of the blade 6. The blade 6 can have an aperture 34 proximate the handle 50. The longitudinal axis of the blade 6 is substantially parallel to the spine 14 and runs from the tip 18 to the rear end 38 of the blade 6.

The knife 2 can comprise a handle 50 with opposing scales 54 covering the liners 58 (shown in FIGS. 3-4), a clip 70, and a locking mechanism, which may be a liner lock 78. Other locking mechanisms can be used in this and other embodiments without departing from the invention. The handle 50 has a forward end 62 proximate the rear end 38 of the blade 6 and a rear end 64 opposite the forward end 62. The handle 50 has a top surface 68 in line with the spine 14 of the blade 6 and a bottom surface 66 in line with the cutting edge 10 of the blade 6 when the knife 6 is in the open position.

The handle 50 generally has two scales 54 and two liners 58, where each scale 54 is positioned on an outer surface of each liner 58. Preferably, the liners 58 are metal, but the liners 58 can be any known material, for example, hard plastic, composite, carbon fiber, fiberglass, wood, ceramic, etc., or combinations thereof. The scales 54 can be plastic, carbon fiber, composite material, fiberglass, metal, wood, or any other material known in the art, or combinations thereof. The liners 58 are separated by a space that forms a channel 74 in the handle 50. The channel 74 receives the blade 6 when the folding knife 2 is in a closed position (FIGS. 6-10). The channel 74 width may be determined by the length of the spacers 60 positioned between the liners 58. One side of the handle 50 can include one liner 58 and one scale 54. The other side of the handle 50 can include one liner 58 and one scale 54. The two sides of the handle 50 can be interconnected to one another via fasteners 90, 94. The fasteners 90, 94 may be rivets, screws, nails, pins, or any other similar mechanism known in the art, or combinations thereof. The fasteners 90, 94 may also interconnect each liner 58 to its corresponding scale 54. Alternatively, each liner 58 may be interconnected or secured to its corresponding scale 54 via glue, epoxy, or other adhesive substance. The spacers 60 may be hollow such that the fasteners 90, 94 are positioned within the spacers 60. In some embodiments, the fasteners 90, 94 are the spacers 60, i.e., they can be one piece. The clip 70 can be positioned on the outer surface of either scale 54, i.e., it can be positioned on the other side of the handle 50 in other embodiments.

In some embodiments, the handle 50 can include a cutout 86 on one side or both sides of the handle 50 to increase access to the traction surface 30 when the knife 2 is in the closed position. In some embodiments, the cutout 86 can be positioned on the forward end 62 of the handle 50 and the upper surface 68 of the handle. The cutout 86 can have a curved shape (e.g., see FIG. 1) or and angled shape (e.g., see FIG. 2). If the knife 2 has two cutouts 86 (i.e., one on each side of the handle 50), then the cutouts 86 may be the same shape or different shapes. In some embodiments, the cutouts 86 form an angle greater than about 90 degrees. In other embodiments, the cutouts 86 may form an angle less than about 90 degrees. In some embodiments, the cutout 86 can extend from the upper surface 68 of the handle 50 to about halfway down the height H1 of the handle 50 (i.e., the height H2 of the cutout 86). In some embodiments, the cutout 86 can extend from the upper surface 68 of the handle 50 down about ⅓ of the height H1 of the handle 50 (i.e., the height H2 of the cutout 86). In some embodiments, the cutout 86 can extend from the forward end 62 of the handle 50 rearward between about 5% and 20% of the length L1 of the handle 50 (i.e., the length L2 of the cutout 86). In some embodiments, the cutout 86 can extend from the forward end 62 of the handle 50 rearward between about 10% and 15% of the length L1 of the handle 50 (i.e., the length L2 of the cutout 86).

In the embodiment shown, the knife 2 has a liner lock 78. The liner lock 78 is built into one of the liners 58 in the handle 50. However, the folding knife 2 can have any type of locking mechanism in other embodiments, for example, a frame lock, an axis lock, a ball lock, etc., and combinations thereof. Additionally, and depending on the type of locking mechanism, the handle 50 may have a cutout 82 to permit access to the locking mechanism. For example, a folding knife with a liner lock typically has a cutout 82 in the handle to allow the user to have access to the liner lock 78.

Figure 3:
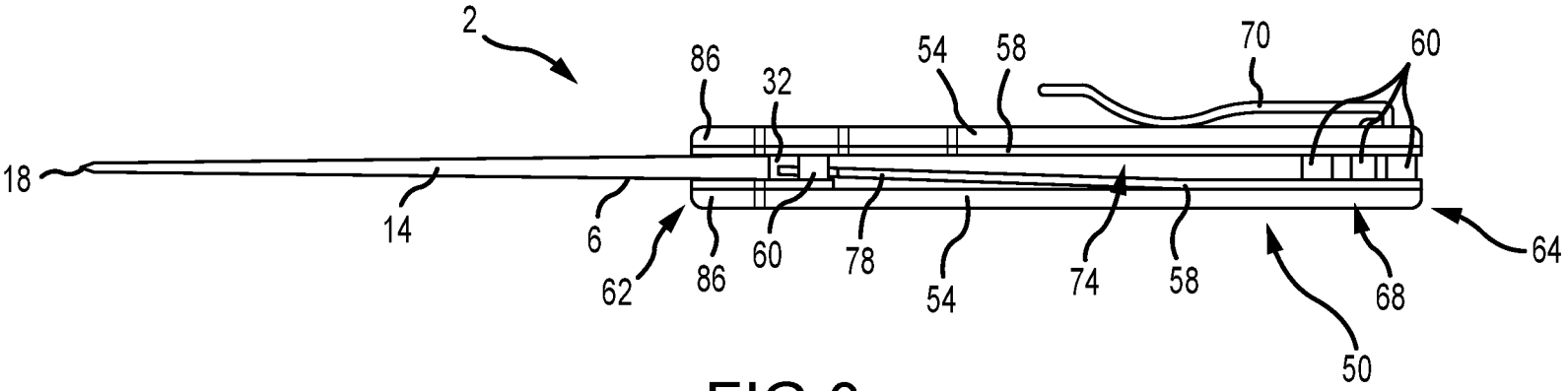
FIG. 3 is a top plan view of the folding knife, shown in an open position.

FIG. 3 is a top plan view of the folding knife 2, shown in an open position. The channel 74 in the handle 50 and the liner lock 78 are visible in this view. The cutouts 86 in the scales 54 and liners 58 are proximate the front 62 of the handle 50. Additionally, the functionality of the liner lock 78 is also shown. When the knife 2 is in the open position, the bottom surface of the liner lock 78 is positioned on and touches the flat surface 32 of the tang. A portion of the top surface of the liner lock 78 is positioned below and may touch the bottom of the spacer 60 proximate the front 62 of the handle 50. The combination of these pieces can prevent the blade 6 from inadvertently rotating to the closed position and/or over rotating beyond the open position.

Figure 4:
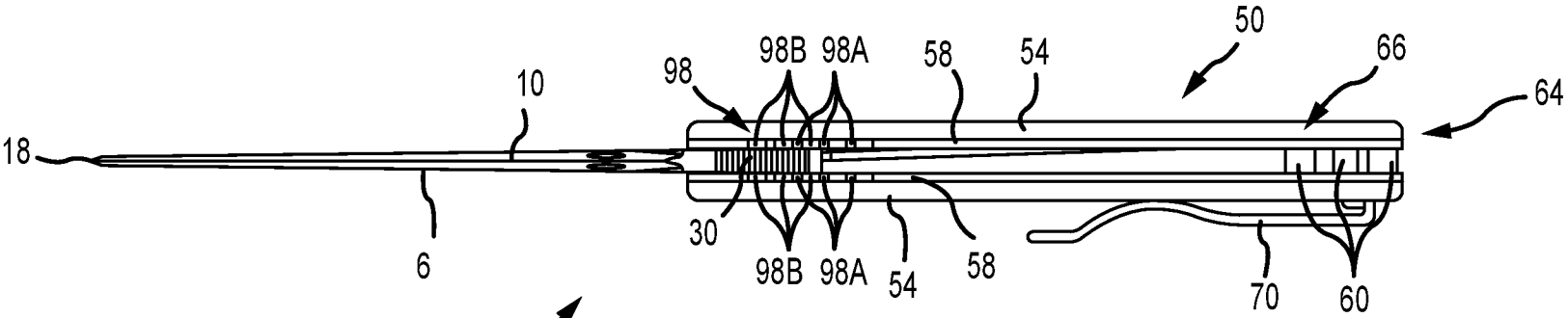
FIG. 4 is a bottom plan view of the folding knife, shown in an open position.

FIG. 4 is a bottom plan view of the folding knife 2, shown in an open position. Here, the tang 26 of the blade 6 with the traction surface 30 is visible. The traction surface 30 is positioned on an outer surface of the tang 26. The outer surface is substantially perpendicular to a longitudinal axis of the blade 6 and substantially perpendicular to the two side surfaces of the blade 6 (i.e., the first side 8 and the second side 12 of the blade 6). The outer surface of the tang 26 is in line with the spine 14 of the blade 6 and extends from the spine 14 to the cutting edge 10. The bottom surfaces of the liners 58 also have traction portions 98 (which may be called "serrated portions" herein) to add traction and assist with gripping when the blade 6 is in the open and extended position. The traction portions 98 can include raised ridges 98A alternating with recessed portions 98B. The raised ridges 98A may have smooth outer surfaces that are flat or rounded. The raised ridges 98A may have texture, for example, a knurled pattern. The recessed portions 98B may be curved and smooth in some embodiments. In some embodiments, the traction surface 30 of the tang 26 is in line with the bottom surface 66 of the handle 50 and the raised ridges 98A of the traction portions 98 such that when the knife 2 is in the open position, the user's finger (e.g., index finger or other finger) can be positioned on the traction surface 30 of the tang 26 and the raised ridges 98A of the traction portions 98. This provides the user with a better grip on the knife 2 and more control over the knife 2. In some embodiments, the traction surface 30 is recessed within the channel 74 when the blade 6 is in the first extended position.

Figure 5:
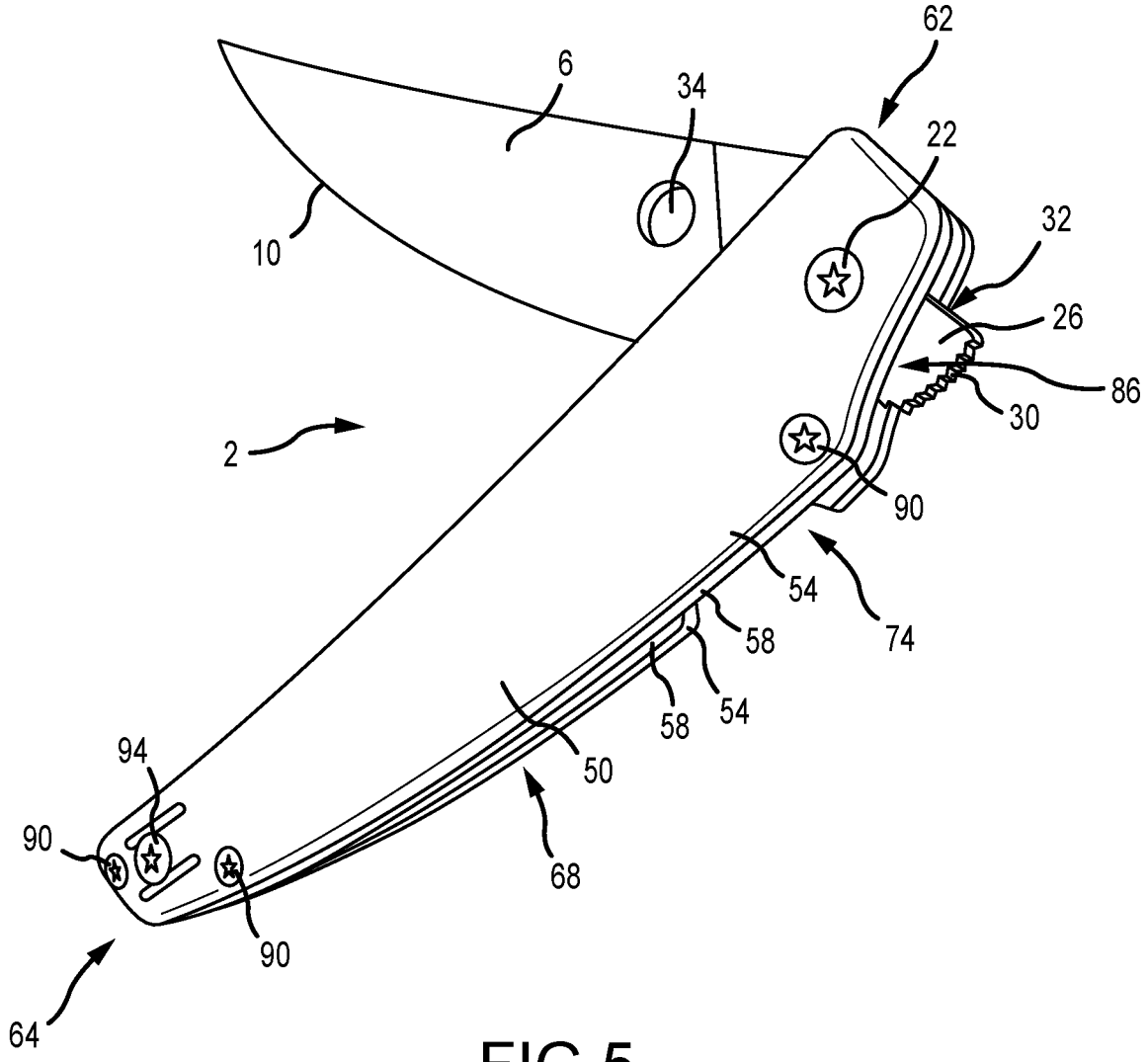
FIG. 5 is a perspective view of the folding knife, shown in a partially open position.

FIG. 5 is a perspective view of the folding knife 2, shown in a partially open position. Here, the tang 26 of the blade 6 and the traction surface 30 are visible. The tang 26 has a flat surface 32 for engaging the liner lock 78. Additionally, the flat surface 32 can be used by the user to rotate the blade 6 from the closed position to the open and extended position. In the embodiment shown, the traction surface 30 includes a plurality of alternating raised ridges and grooves. The ridges are parallel to one another and extend from one side 8 of the blade 6 to the other side 12 of the blade 6. The grooves are parallel to one another and extend from one side 8 of the blade 6 to the other side 12 of the blade 6. The ridges and grooves are positioned along the outer surface of a portion of the tang 26. This pattern can be created using a knurling process or any other known method. In other embodiments, the traction surface 30 may be a crisscross pattern similar to a traditional knurled pattern or any other pattern to create a surface with increased friction.

Figure 6:
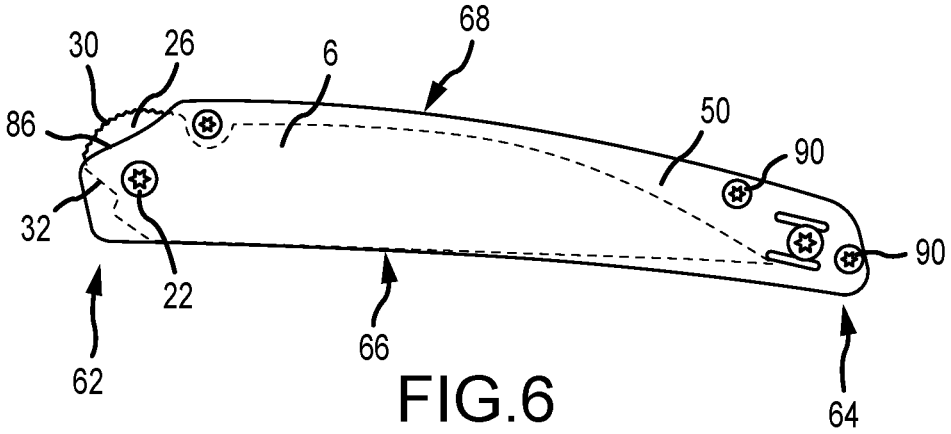
FIG. 6 is a front elevation view of the folding knife, shown in a closed position.
Figure 7:
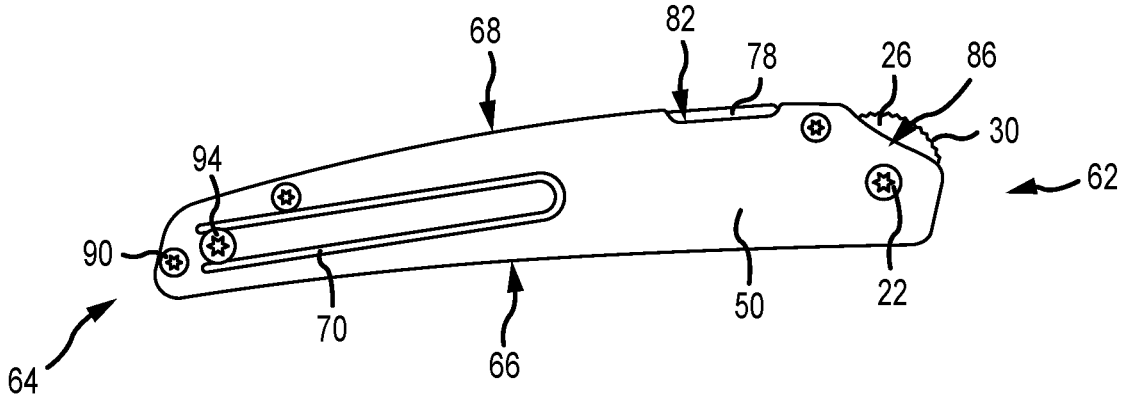
FIG. 7 is a rear elevation view of the folding knife, shown in a closed position.

FIGS. 6 and 7 show the folding knife 2 in the closed position. FIG. 6 is a front elevation view and shows the concealed portion of the blade 6 in phantom lines. FIG. 7 is a rear elevation view of the folding knife 2. When the knife 2 is in the closed position, a portion of the tang 26 is visible and accessible proximate the forward end 62 and upper surface 68 of the handle 50. The handle 50 may even have a cutout 86 proximate the forward end 62 and upper surface 68 such that more of the tang 26 of the blade 6 is visible and accessible when the knife 2 is in the closed position. In some embodiments, the flat surface 32 of the tang 26 is concealed by the handle 50 when the knife 2 is in the closed position. When the knife 2 is in the closed position, the traction surface 30 on the tang 26 is visible and accessible because the traction surface 30 is located on an outer surface of the tang 26 of the blade 6 and extends outwardly from the handle 50 when the blade 6 is in the closed position. Thus, the user can apply a force on the traction surface 30 to rotate the blade 6 from the closed position to the open position. The handle 50 may also have a second cutout 82 to permit easy access to the liner lock 78 (shown in FIG. 7). The traction surface 30 makes it easier for the user to rotate the tang 26 and, thus, rotate the blade 6 from the closed position to the open position, preferably with a thumb or an index finger. In FIG. 6, the user rotates the tang 26 of the blade 6 in the clockwise direction to open the knife 2; whereas in FIG. 7 the user rotates the tang 26 of the blade 6 in the counter-clockwise direction to open the knife 2.

Figure 8:
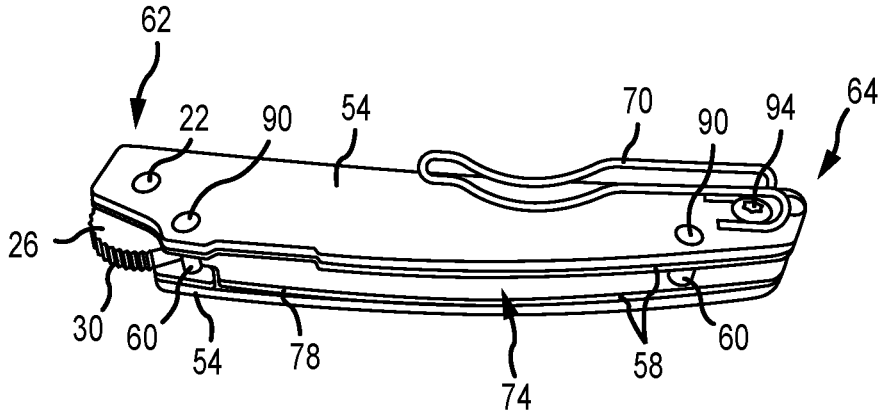
FIG. 8 is a top perspective view of the folding knife, shown in a closed position.

FIG. 8 is a top perspective view of the folding knife 2, shown in a closed position. Here, the channel 74 and liners 58 are visible. Further, the tang 26 with the traction surface 30 is clearly shown. To open the blade 6, the user pushes on the traction surface 30 of the tang 26 and rotates the tang 26 in the counter-clockwise direction.

Figure 9:
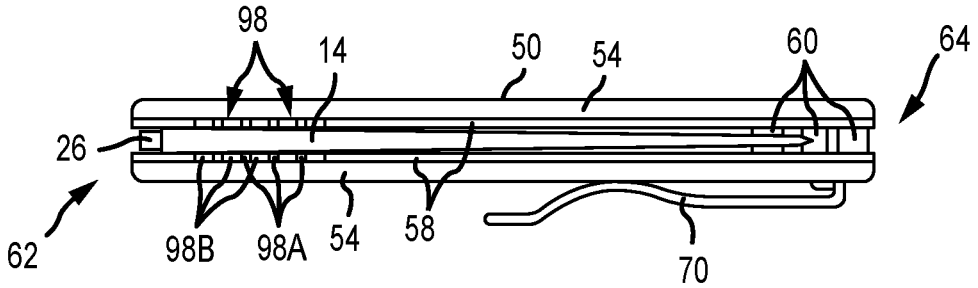
FIG. 9 is a bottom plan view of the folding knife, shown in a closed position.

FIG. 9 is a bottom plan view of the folding knife 2, shown in a closed position. Here, the spine 14 of the blade 6 is visible, along with the scales 54 and the liners 58. Only a small portion of the tang 26 is visible in this view. The bottom surfaces of the liners have traction portions 98 to add traction and assist with gripping when the knife 2 is in the open position and the blade 6 is extended. The traction portions 98 can include alternating raised ridges 98A and recessed portions 98B. When the knife 2 is in the closed position, the spine 14 of the blade 6 may interfere with the functionality and use of the traction portions 98.

Figure 10:
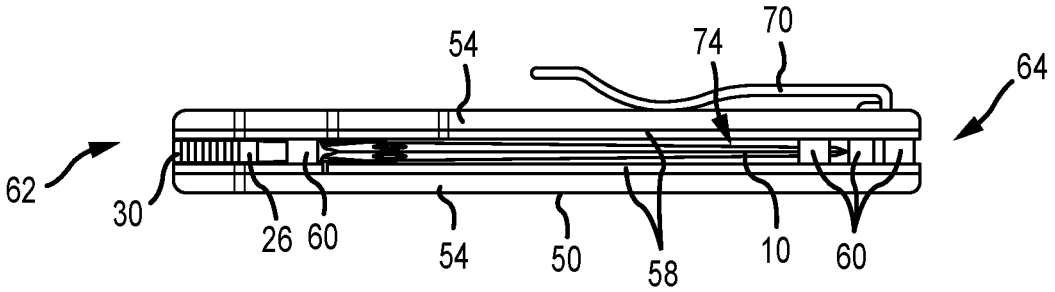
FIG. 10 is a top plan view of the folding knife, shown in a closed position.

FIG. 10 is a top plan view of the folding knife 2, shown in a closed position. In this view, the cutting edge 10 of the blade 6 is visible, along with the tang 26 and the traction surface 30. The blade 6 is positioned in the channel 74 of the handle 50. The spacers 60 may also prevent over-rotation of the blade 6 through the channel 74.

Figure 11:
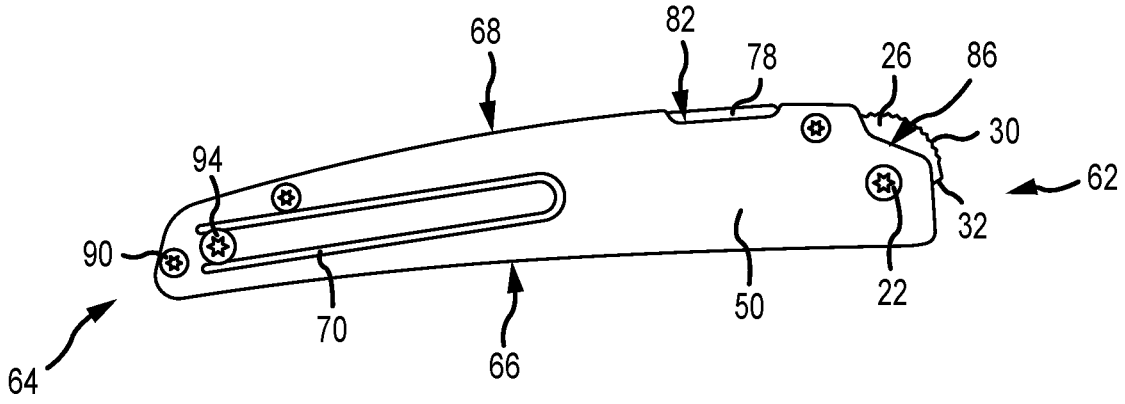
FIG. 11 is a rear elevation view of an alternative embodiment of a folding knife, shown in a closed position.

FIG. 11 is a rear elevation view of an alternative embodiment of a folding knife, shown in a closed position. The difference between this embodiment and the embodiment(s) shown in the other figures is that the forward end 62 of the handle 50 has a slightly different shape. Specifically, the forward end 62 is more vertical below the cutout 86. Other embodiments (for example, as shown in FIG. 7) have an angled forward end 62 of the handle 50 below the cutout 86. Thus, when the knife 2 is in the closed position, a portion of the tang 26 is visible and accessible proximate the forward end 62 and upper surface 68 of the handle 50. The handle 50 may even have a cutout 86 proximate the forward end 62 and upper surface 68 such that more of the tang 26 of the blade 6 is visible and accessible when the knife 2 is in the closed position. Moreover, a portion of the tang with the traction surface 30 and flat surface 32 extends beyond the handle (i.e., beyond the scale and/or liner) such that the user can grip a portion of the flat surface 32 to assist in opening the knife 2. As shown in FIG. 11, where the traction surface 30 transitions to the flat surface 32 of the tang 26 creates a corner that the user can use to assist with opening the knife 2. When the knife 2 is in the closed position, the traction surface 30 on the tang 26 is visible and accessible because the traction surface 30 is located on an outer surface of the tang 26 of the blade 6 and extends outwardly from the handle 50 when the blade 6 is in the closed position. Thus, the user can apply a force on the traction surface 30 and/or flat surface 32 to rotate the blade 6 from the closed position to the open position. The handle 50 may also have a second cutout 82 to permit easy access to the liner lock 78. The traction surface 30 and/or flat surface 32 makes it easier for the user to rotate the tang 26 and, thus, rotate the blade 6 from the closed position to the open position, preferably with a thumb or index finger. In FIG. 11, the user rotates the tang 26 of the blade 6 in the counterclockwise direction to open the knife 2.

The blade 6 is typically metal, but can be any known material such as ceramic, fiberglass, plastic, or combinations thereof. In some embodiments, the stop mechanism can be a stop pin in the handle and the stop pin extends across the cavity in the handle. In various embodiments, the stop mechanism can be the liner lock positioned between the tang of the blade and the pivot pin when the knife is in the open and extended position. The stop mechanism is typically the same material as the blade and, thus, is also metal. However, the stop mechanism can be any other material known and used in the art. Additionally, the stop mechanism can be a material that is different from the blade. For example, the blade may be one type of metal and the stop mechanism may be a different type of metal or a hard plastic, etc.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A folding tool comprising:

a handle with two sides, a forward end, and a rear end opposite the forward end, wherein at least one side has a cutout proximate the forward end, wherein the cutout extends from an upper surface of the handle to the forward end of the handle, and wherein the cutout extends down from the upper surface a distance of between about half of a height of the forward end of the handle and about one-third of the height of the forward end of the handle and is positioned above a pivot point of the handle;

a tool moveable from a first extended position to a second closed position and having a forward end, a tang on a rear end, and a longitudinal axis, wherein the tool is pivotally interconnected to the forward end of the handle at the pivot point;

a traction surface located on an outer surface of the tang, wherein the traction surface is knurled, wherein a majority of the traction surface extends upwardly above the cutout in the handle and above the pivot point to facilitate engagement when the tool is in the second closed position, and wherein when a force is applied to the traction surface when the tool is in the second closed position, the tool rotates to the first extended position; and a locking mechanism moveable from a first locked position to a second released position, wherein the locking mechanism is in the first locked position when the tool is in the first extended position.

2. The folding tool of claim 1, wherein the tool is a blade having a spine and a cutting edge opposite the spine and the longitudinal axis is substantially parallel to the spine.

3. The folding tool of claim 1, wherein the locking mechanism is a liner lock.

4. The folding tool of claim 1, wherein the traction surface comprises a knurled pattern of straight ridges.

5. The folding tool of claim 1, wherein the traction surface extends around an outer surface of the tang an angle of at least about 90 degrees as measured from the pivot point.

6. The folding tool of claim 1, wherein a second portion of the outer surface of the tang comprises a flat surface that is smooth.

7. The folding tool of claim 6, wherein a portion of the tang comprising the traction surface and the flat surface extends outwardly beyond the forward end of the handle when the tool is in the second closed position.

8. The folding tool of claim 6, wherein the flat surface engages a portion of the locking mechanism when the tool is in the first extended position.

9. The folding tool of claim 1, wherein the handle further comprises a first liner, a second liner, a first scale, and a second scale that are substantially parallel to one another, wherein there is a space between the first and second liners that forms a channel for receiving the tool when the tool is in the second closed position, and wherein a portion of the first liner proximate the forward end of the handle and a portion of the second liner proximate the forward end of the handle comprise a traction portion with alternating raised ridges and recessed portions.

10. The folding tool of claim 1, wherein at least a portion of the traction surface extends outwardly from the forward end of the handle when the tool is in the second closed position.

11. The folding tool of claim 1, wherein a portion of the traction surface is substantially parallel with a bottom surface of the handle when the tool is in the first extended position.

12. The folding tool of claim 1, wherein the outer surface of the tang is oriented substantially perpendicular to the longitudinal axis of the tool.

13. A folding knife comprising:

a handle comprising:

a first side with a first liner, a first scale, and a first cutout in a forward end of the handle extending from an upper surface of the handle to the forward end of the handle, wherein the first cutout forms an angle greater than about 90 degrees; and a second side with a second liner, a second scale, and a second cutout in the forward end of the handle extending from the upper surface of the handle to the forward end of the handle, wherein the second cutout forms an angle greater than about 90 degrees, and wherein there is a space between the first and second liners that forms a channel;

a blade moveable from a first extended position to a second closed position and having a forward end, a tang on a rear end, a spine, a cutting edge opposite the spine, and a longitudinal axis extending from the forward end to the rear end, wherein the blade is pivotally interconnected to the forward end of the handle via a pin, and wherein the channel receives the cutting edge of the blade when the blade is in the second closed position;

a traction surface extending along an arc length of at least about 60 degrees of an exposed outer surface of the tang when the blade is in the second closed position, wherein the traction surface extends outwardly from and above the first and second cutouts in the handle when the blade is in the second closed position such that the arc length of at least about 60 degrees of the traction surface is visible when the blade is in the second closed position but the traction surface does not extend beyond a perimeter of the handle when the blade is in the first extended position, wherein a second portion of the tang comprises a flat surface that is smooth and the flat surface does not extend outwardly from the first and second cutouts in the handle when the blade is in the second closed position, and upon applying a reward-oriented force to the traction surface the blade rotates around the pin to the first extended position; and a liner lock cut into the first liner, wherein the liner lock is moveable from a first locked position to a second released position, wherein the liner lock is in the first locked position when the blade is in the first extended position, and wherein the substantially flat surface of the tang engages a portion of the liner lock when the blade is in the first extended position.

14. The folding knife of claim 13, wherein the traction surface is knurled.

15. The folding knife of claim 13, wherein the traction surface comprises a knurled pattern of straight ridges.

16. The folding knife of claim 13, wherein the traction surface is recessed within the channel when the blade is in the first extended position.

17. The folding knife of claim 13, wherein the exposed outer surface is substantially perpendicular to the longitudinal axis of the blade.

18. A method of opening a folding knife with one hand, comprising:

providing the folding knife comprising:

a handle with a cutout in a forward end of the handle extending from an upper surface of the handle to the forward end of the handle, wherein the cutout forms an angle greater than about 90 degrees;

a blade moveable from a first extended position to a second closed position and having a forward end, a tang on a rear end, a spine, a cutting edge opposite the spine, and a longitudinal axis, wherein the blade is pivotally interconnected to a forward end of the handle;

a traction surface located on a portion of an outer surface of the tang, wherein the traction surface is knurled, wherein the outer surface is positioned substantially perpendicular to the longitudinal axis of the blade, the outer surface also comprising a flat surface that transitions into the traction surface at an approximately 90 degree angle, and wherein a portion of the traction surface measuring at least about 60 degrees in arc length extends upwardly above the cutout in the handle when the blade is in the second closed position to facilitate engagement; and a locking mechanism moveable from a first locked position to a second released position, wherein the locking mechanism is in the first locked position when the blade is in the first extended position and a portion of the locking mechanism engages the flat surface of the tang when the blade is the first extended position;

applying a force in a rearward-oriented direction to the traction surface to facilitate rotation of the blade from the second closed position to the first extended position; and locking the blade in the first extended position with the locking mechanism.

19. The method of opening a folding knife of claim 18, wherein the locking mechanism includes a portion of a liner in the handle that engages a portion of the tang when the blade is in the first extended position.

20. The method of opening a folding knife of claim 18, wherein the traction surface comprises a knurled pattern of straight ridges.

21. The method of opening a folding knife of claim 18, further comprising using an index finger or thumb to apply the force to the traction surface to open the folding knife.

* * * * *